US006968651B2

(12) United States Patent
Bergeron

(10) Patent No.: US 6,968,651 B2
(45) Date of Patent: Nov. 29, 2005

(54) LEAF GUARD FOR GUTTERS

(76) Inventor: Rodolphe S. Bergeron, Central Sheet Metal, 560 Mineral Spring Ave., Pawtucket, RI (US) 02890

( * ) Notice: Subject to any disclaimer, the term of this patent is extended or adjusted under 35 U.S.C. 154(b) by 0 days.

(21) Appl. No.: 10/164,593

(22) Filed: Jun. 10, 2002

(65) Prior Publication Data

US 2003/0009951 A1 Jan. 16, 2003

Related U.S. Application Data

(63) Continuation-in-part of application No. 09/298,919, filed on Apr. 23, 1999, now abandoned.

(51) Int. Cl.[7] ..... E04D 13/064
(52) U.S. Cl. ..... 52/12
(58) Field of Search ..... 52/12, 11, 15, 16, 52/169.5, 302.1, 302.6, 733.2, 733.3, 670, 52/671, 672, 673, 674; 210/163, 164, 473, 210/474; 428/595, 596, 597, 598, 603

(56) References Cited

U.S. PATENT DOCUMENTS

| | | | | | |
|---|---|---|---|---|---|
| 2,271,081 | A | | 1/1942 | Layton | 108/30 |
| 3,177,620 | A | * | 4/1965 | Brown et al. | 52/733.2 |
| 3,436,878 | A | | 4/1969 | Singer | 52/12 |
| 4,750,300 | A | | 6/1988 | Winger, Jr. | 52/12 |
| 4,937,986 | A | | 7/1990 | Way, Sr. et al. | 52/12 |
| 4,941,299 | A | | 7/1990 | Sweers | 52/12 |
| 5,095,666 | A | | 3/1992 | Williams, Jr. | 52/11 |
| 5,321,920 | A | | 6/1994 | Sichel | 52/12 |
| 5,375,379 | A | | 12/1994 | Meckstroth | 52/12 |
| 5,459,965 | A | | 10/1995 | Meckstroth | 52/12 |
| 5,471,798 | A | | 12/1995 | Kuhns | 52/12 |
| 5,495,694 | A | | 3/1996 | Kuhns | 52/12 |
| 5,619,825 | A | | 4/1997 | Leroney et al. | 52/12 |
| 5,640,809 | A | * | 6/1997 | Iannelli | 52/12 |
| 5,842,311 | A | | 12/1998 | Morin | 52/12 |
| 5,911,659 | A | | 6/1999 | Serano | 52/12 |
| 6,016,631 | A | | 1/2000 | Lowrie, III | 52/12 |
| 6,047,502 | A | * | 4/2000 | Kimmitt et al. | 52/12 |
| 6,073,398 | A | | 6/2000 | Williams | 52/12 |
| 6,185,824 | B1 | * | 2/2001 | McClure et al. | 52/749.1 |
| 6,301,849 | B1 | * | 10/2001 | Roth | 52/302.6 |
| 6,412,228 | B1 | * | 7/2002 | Meckstroth | 52/12 |

FOREIGN PATENT DOCUMENTS

| | | | | |
|---|---|---|---|---|
| JP | 3-202541 | * | 9/1991 | 52/12 |
| WO | WO 95/02100 | * | 1/1995 | 52/12 |

* cited by examiner

*Primary Examiner*—Michael Safavi
(74) *Attorney, Agent, or Firm*—Finnegan, Henderson, Farabow, Garrett & Dunner, L.L.P.

(57) ABSTRACT

A leaf guard is provided to be mounted to a gutter. In accordance with one preferred embodiment, a leaf guard for a gutter mounted to an edifice is provided. The leaf guard is formed of a single sheet of rigid material and includes a first section having one end adapted to be secured to the edifice, a first bend, and a second section connected to the first section at the first bend, the second section including apertures to permit water to pass therethrough and adapted to extend from the first bend to an inner edge of the gutter, wherein the first section, first bend and the second section are constructed and arranged so that the bend is substantially even with or below the inner edge of the gutter when the guard is mounted to the edifice and gutter.

6 Claims, 9 Drawing Sheets

LEAF GUARD FOR GUTTERS

This application is a continuation-in-part of prior Application Ser. No. 09/298,919, filed Apr. 23, 1999, now abandoned.

FIELD OF THE INVENTION

This invention relates to leaf guards for rain gutters.

BACKGROUND OF THE INVENTION

For years, homeowners have had to deal with the annual chore of cleaning their gutters. They can either perform this task themselves or be forced to pay the expense of hiring outside help. Another option is to use one of the unsightly and flimsy mesh guards that are currently on the market. There is a need for a sturdy, easy to install, easy to remove, aesthetic and inconspicuous leaf guard cover for gutters. Accordingly, it is an object of the invention to provide an improved leaf guard for gutters.

SUMMARY OF THE INVENTION

A leaf guard is provided to be mounted to a gutter. In accordance with one preferred embodiment, a leaf guard for a gutter mounted to an edifice is provided. The leaf guard is formed of a single sheet of rigid material and includes a first section having one end adapted to be secured to the edifice, a first bend, and a second section connected to the first section at the first bend, the second section adapted to extend from the first bend to an inner edge of the gutter, wherein the first section, first bend and the second section are constructed and arranged so that the bend is below the inner edge of the gutter when the guard is mounted to the edifice and gutter, and at least one of the first and section sections includes apertures adjacent the bend to permit water to pass therethrough.

According to another embodiment, a leaf guard for a gutter mounted on an edifice is provided. The leaf guard is formed of a single sheet of rigid material and includes a first section having one end adapted to be secured to the edifice, the first section adapted to extend from the edifice to substantially an inner edge of the gutter, wherein the first section does not permit water to pass therethrough, and a second section connected to the first section, the second section including apertures to permit water to pass therethrough.

DETAILED DESCRIPTION

Figure 1:
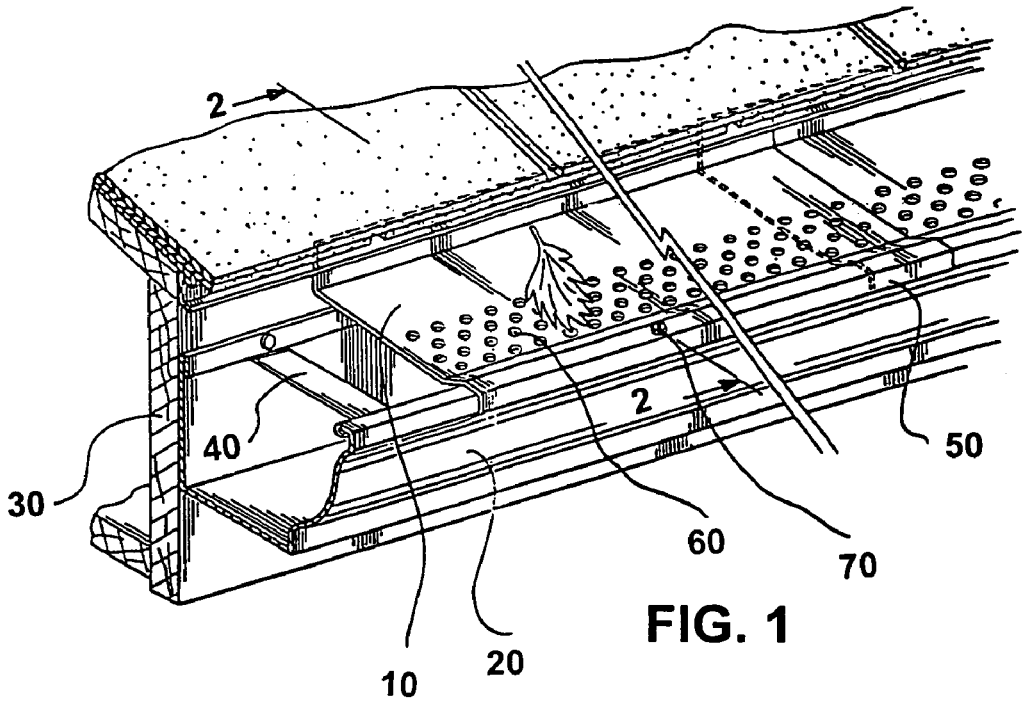
FIG. 1 is a perspective view of the leaf guard according to one embodiment mounted on a gutter.

FIGS. 1–13 show various embodiments of leaf guards consistent with principles of the present invention. It should be understood that the foregoing embodiments are exemplary only, and that various features from the embodiments can be imported into other embodiments while remaining consistent with principles of the present invention. Like reference characters are used wherever possible throughout the figures.

Figure 2:
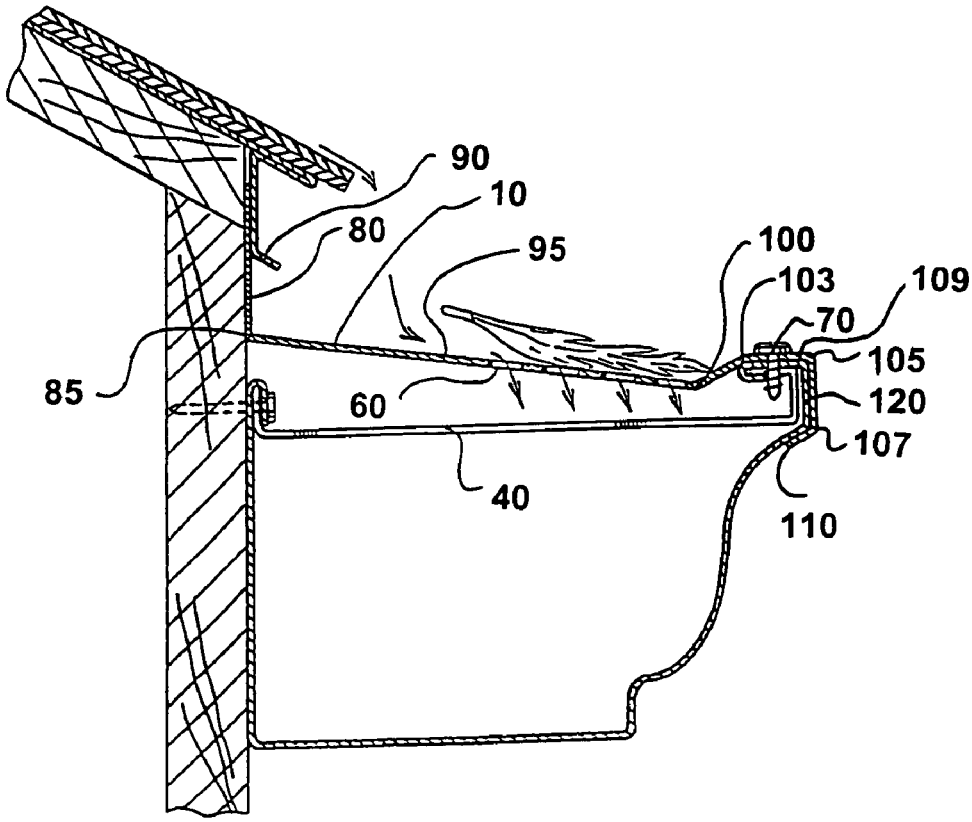
FIG. 2 is a cross-sectional view taken along line 2—2 of FIG. 1.

FIGS. 1 and 2 show one embodiment of a leaf guard 10 for a rain gutter 20 according to one embodiment of the present invention. The leaf guard 10 is formed with a single sheet of rigid material, preferably aluminum sheet metal, or any other rigid material, e.g., plastic, which could be formed into the leaf guard shapes disclosed herein.

Individual leaf guards 10 are mounted to a rain gutter 20 secured to a house, or other edifice, 30 via a bracket 40. The guards 10 are mounted to the house 30 and gutter 20 such that the guards 10 overlap one another at 50. Overlapping prevents debris from entering between the guards. When installed the guards 10 prevent debris such as leaves and sticks from falling into the gutter 20, thus relieving the need to repeatedly clean the gutters.

The guard also includes holes 60 which permit water to flow through during rain. The holes 60 are, for example, large enough to permit water to easily flow through the guard and small enough to prevent debris from entering the gutter. One quarter inch holes have been found to work well.

The individual guards 10 are secured in place by a sheet metal screw 70 which passes through the leaf guard 10 and the gutter 20. The guard includes a first section 80 which abuts flush against the side of the house, building or other edifice 30. The section 80 will slide under the drip edge 90 of the house if such a drip edge is provided. The guard is bent at 85 and includes a second section 95 which predominantly covers the gutter. The bend 85 is greater than 90° so that section 95 is angled with respect to edifice 30 so that water flows away from the edifice towards the holes 60.

The guard includes third section that includes a series of bends at 100, 103, 105 and 107 to form a planar section 109 that sits upon an edge of the gutter 20 for accommodating the sheet metal screws 70. The gutter is also bent at 105 and 107 to form a lip 110 that serves to position the gutter guard over the outside edge of the gutter 120. After the guard is positioned as shown, the sheet metal screw is inserted to secure the guard in place.

Figure 2A:
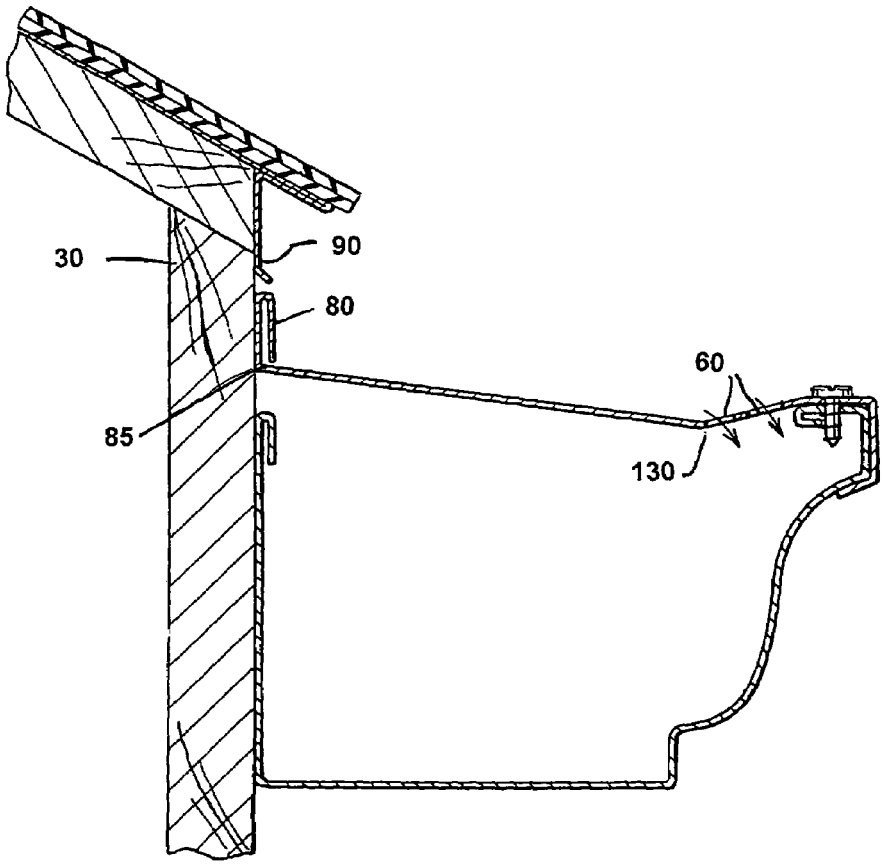
FIG. 2A is a cross-sectional view similar to FIG. 2 of an alternative embodiment of a leaf guard for a gutter.

FIG. 2A shows an alternative embodiment in which the section 80 is folded over itself so that section 80 does not sit under drip edge 90 as shown in FIG. 2. This embodiment also includes an additional bend 130 and shows holes 60 formed after bend 130. Folding over section 80 adds stability and permits the leaf guard to be used in applications where there is less room between the roof and the gutter.

Figure 3:
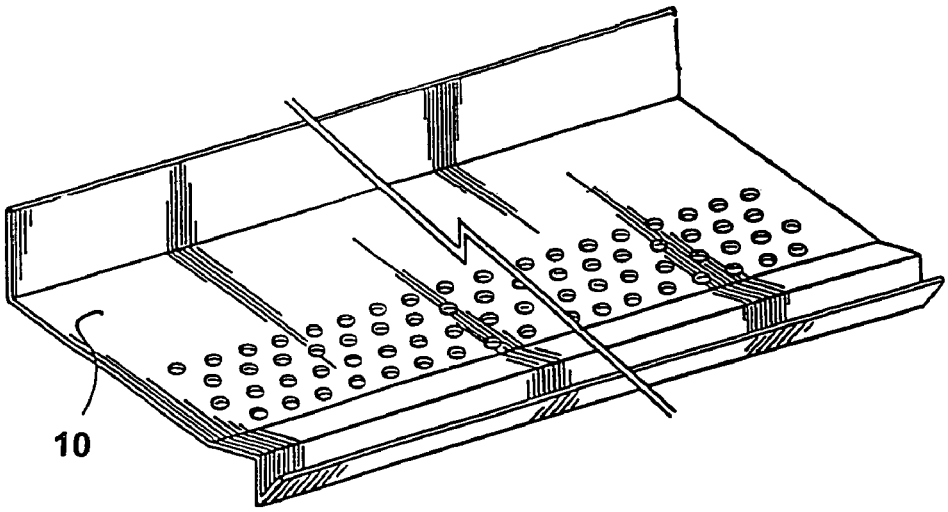
FIG. 3 is a perspective view of another alternative embodiment of a leaf guard.
Figure 4:
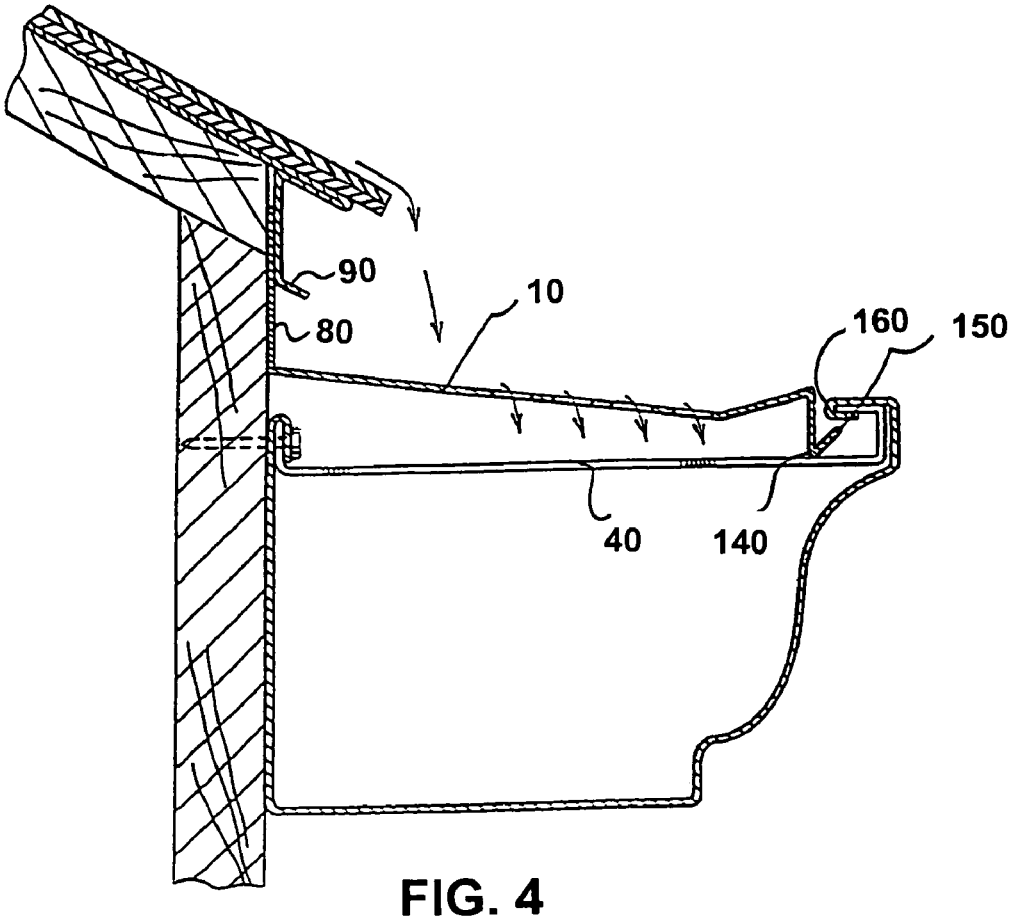
FIG. 4 is a cross-sectional view similar to FIG. 2 showing the alternative leaf guard shown in FIG. 3 mounted to a gutter.

FIGS. 3 and 4 show an alternative embodiment of a leaf guard 10. This embodiment is similar to the embodiment shown in FIGS. 1–2 except with respect to how the leaf guard is secured to the gutter. In this embodiment, to mount the gutter guard, section 80 is positioned under drip edge 90 (as in the previous embodiment), then the gutter guard is pressed down to "snap" into position to rest at 140 on bracket 40. The snapping action occurs when edge 150 of guard 150 is forced past inside edge 160 of the gutter. Both the gutter and the guard are formed of materials that "give" to facilitate this snapping action. In this embodiment the act of using a sheet metal screw is unnecessary.

Figure 5:
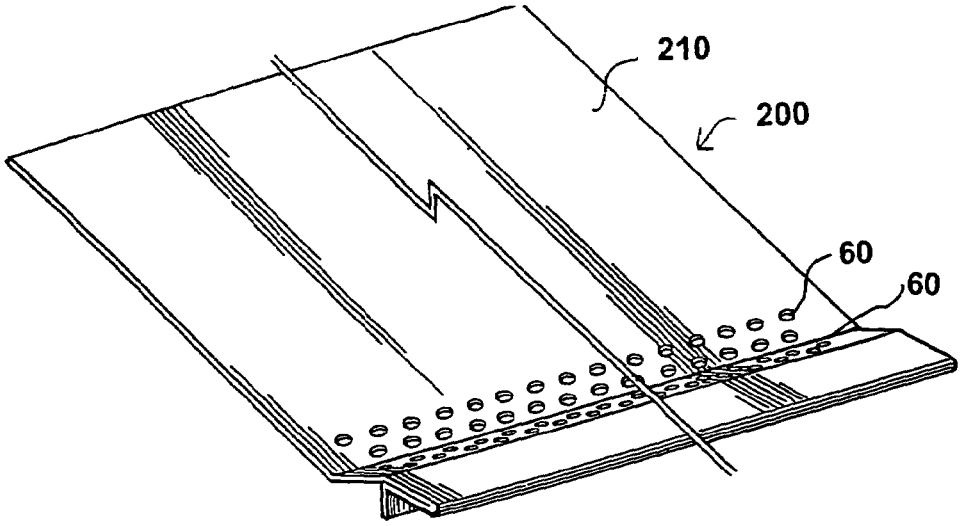
FIG. 5 is a perspective view of another alternative embodiment of a leaf guard.
Figure 6:
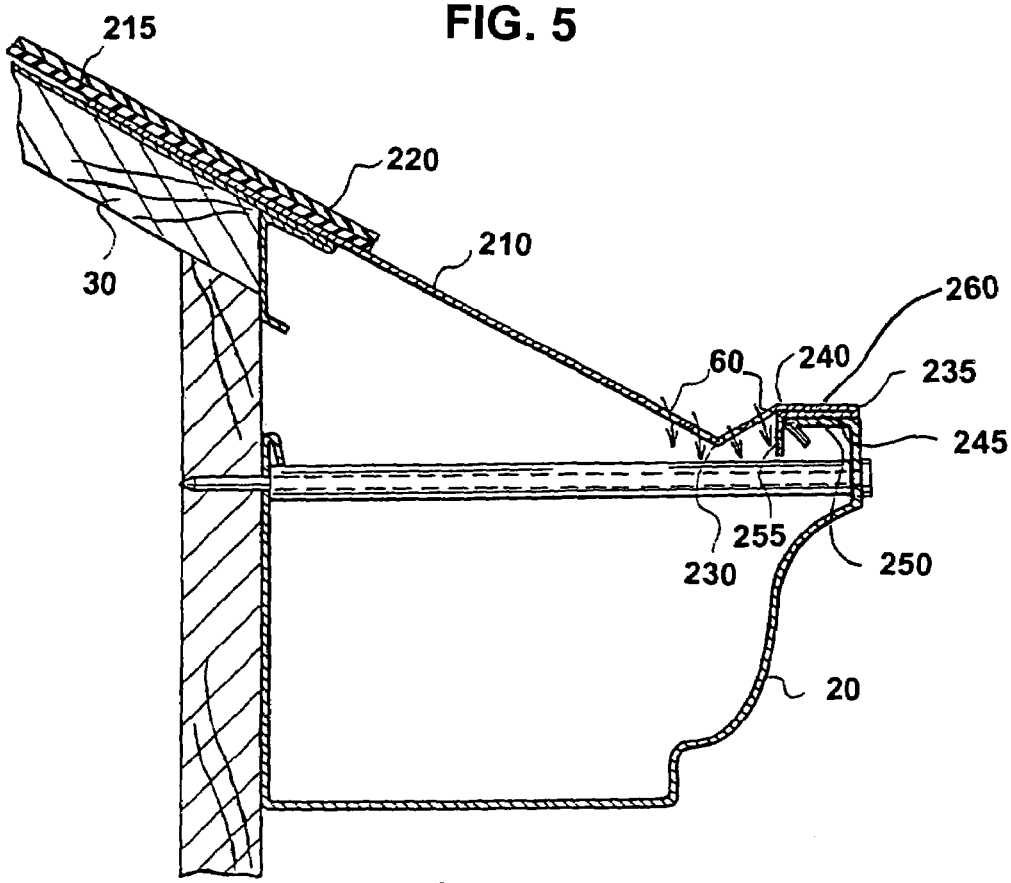
FIG. 6 is a cross-sectional view of the leaf guard of FIG. 5, shown mounted to a gutter.

FIGS. 5 and 6 show another alternative embodiment. In this embodiment, the leaf guard 200 does not include a section 80 as in previous embodiments that abuts the edifice 30. Rather, the guard 200 includes a flat section 210, the end to 15 of which slides under roofing 220 (e.g., shingles). Thus, main section 210 of the leaf guard 100 extends from the roofing at substantially the same angle as the angle of the roofing with respect to the ground. Section 210 extends to a bend 230 about which holes 60 are provided to permit water gathering at bend 230 to flow into the gutter.

The material forming leaf guard 200 is folded over at 235 and bent at 240 to form a section 245 that sits substantially flush upon surface 250 of the gutter. Bend 240 forms a stop section 255 which abuts an inner edge 260 of the gutter and prevents the leaf guard 200 from sliding out of position. An advantage of the embodiment of FIGS. 5 and 6 is that the leaf guard 200 can accommodate many different sized gutters because end 215 of section 210 can be positioned underneath roofing 220 at any location that causes stop section 255 to engage inner edge 260 of the gutter. Thus, the guard does not have to be designed or cut differently to fit different sized gutters.

Figure 7:
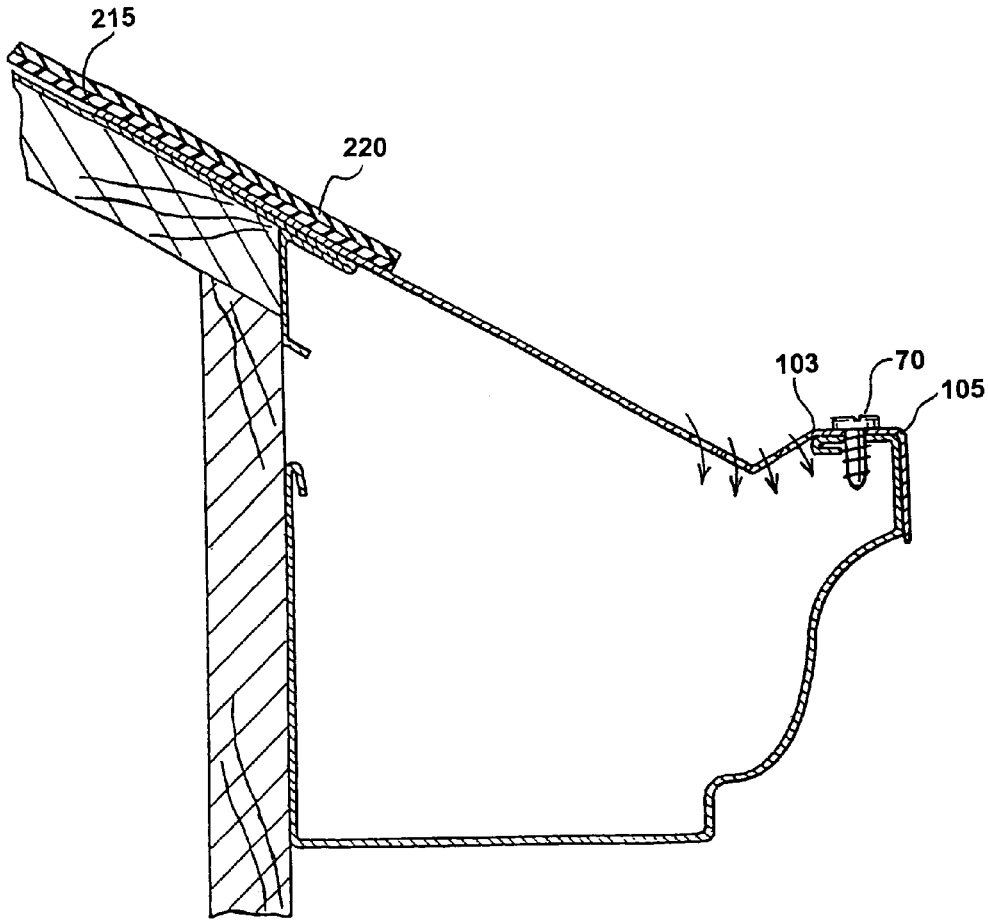
FIG. 7 is a cross-sectional view of another alternative embodiment of a leaf guard, shown mounted to a gutter.

FIG. 7 shows another alternative embodiment similar to the embodiment of FIGS. 5 and 6 with the exception that the leaf guard is attached to the gutter via a set screw 70, similar to the embodiment shown in FIG. 2. As in that embodiment, the leaf guard 200 includes bends 103 and 105 to accommodate the set screw 70 and to sit substantially flush about the edge of the gutter. The embodiment of FIG. 7 has similar advantages to the embodiment of FIGS. 5 and 6 in that end 215 can be slid to any location under roofing 220 to enable bends 103 and 105 to be properly positioned about the edge of the gutter and to receive set screw 70, as shown in FIG. 7.

Figure 8:
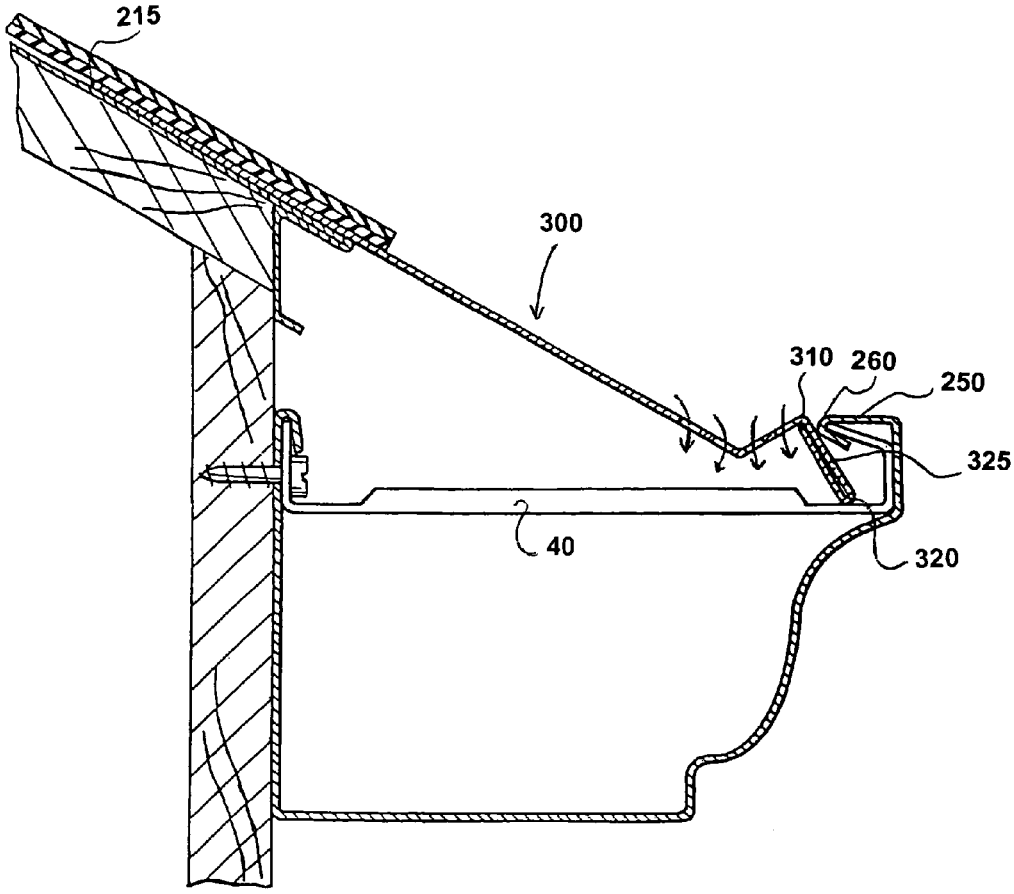
FIG. 8 is a cross-sectional view of another alternative embodiment of a leaf guard, shown mounted to a gutter.

FIG. 8 shows another alternative embodiment using a freely located end 215 of guard 300. The guard 300 is similar in many respects as the guard 200 shown in FIGS. 5 and 6 with the exception of the manner in which the end of the guard 300 is formed. In this embodiment, instead of being formed to sit on top of surface 250 of the gutter (as in FIG. 6), the guard 300 includes a bend 310 which leads to an end 320 of the guard which rests upon bracket 40. Section 325 is formed by the bend 310 and is adapted to abut inner edge 260 of the gutter to keep the guard 300 in place and to prevent debris from falling into the gutter. Freely located end 215 enables section 325 to be positioned to abut edge 260 regardless of the size of the gutter.

Figure 9:
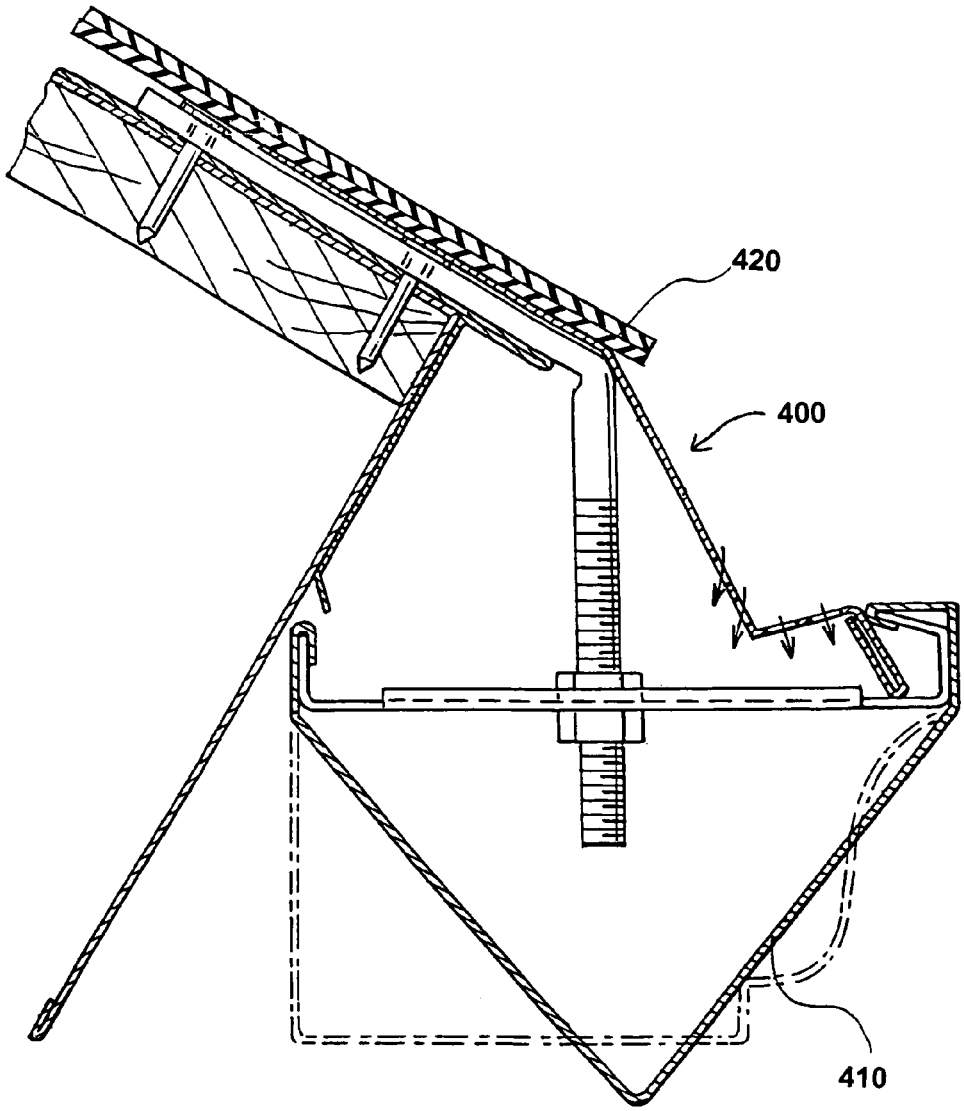
FIG. 9 is a cross-sectional view of another alternative embodiment of a leaf guard, shown mounted to a V-shaped gutter.

An embodiment similar to that shown in FIG. 8 is shown in FIG. 9 in which the guard 400 is used with a hanging V type gutter 410. To accommodate the more steeply V-shaped gutter, an additional bend 420 is provided in the guard 400. In other respects, the guard is similar to the guard 300 shown in FIG. 8.

Figure 10:
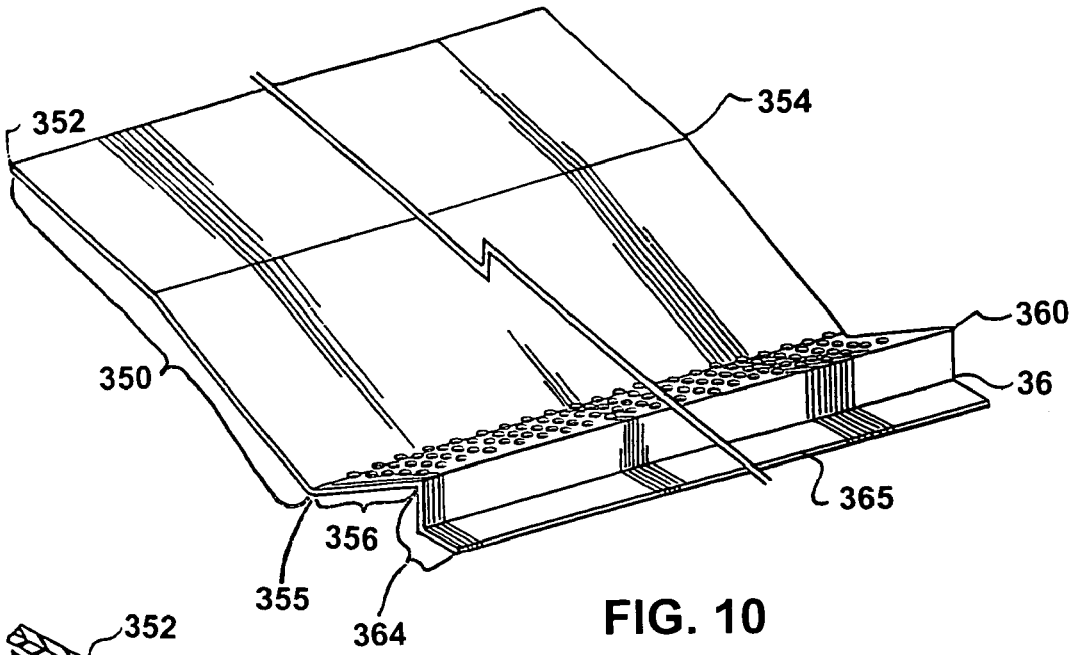
FIGS. 10 and 11 are perspective and cross-sectional mounted views, respectively, of another alternative embodiment of a leaf guard.
Figure 11:
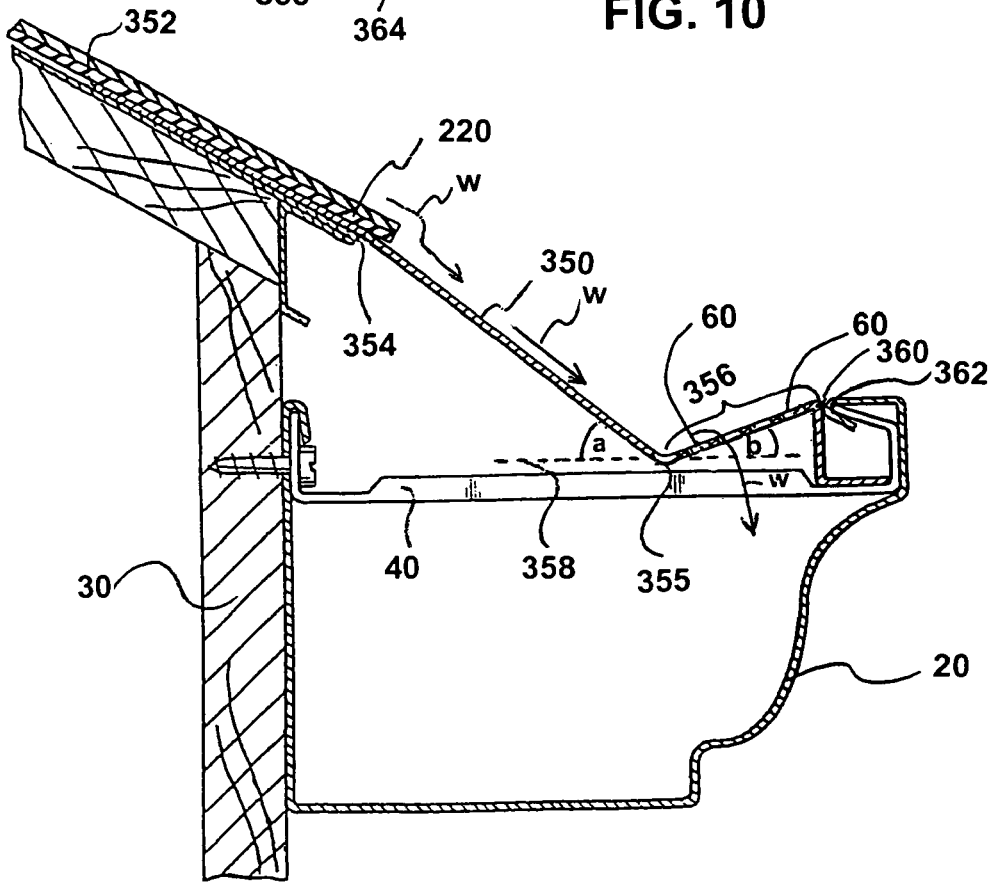

FIGS. 10 and 11 show another alternative embodiment of a leaf guard consistent with the present invention, shown mounted to a gutter 20 and edifice 30 in FIG. 11. The leaf guard is made from a single piece of material, preferably sheet metal or plastic, and includes a first section 350 that includes a first end 352 to slide under and be positioned beneath roofing 220. The first section 350 optionally includes a slight bend 354 to show the installer how far the section 350 should be slid under roofing 220, as well as to properly angle the guard relative to the gutter 20. Whether or not bend 354 is present, section 350 extends substantially parallel from roofing 220 to facilitate both a clean aesthetic appearance and the flow of water indicated by arrow W to proceed from roofing 220 and down section 350.

The first section 350 ends at bend 355 at which second section 356 begins and extends to a second bend 360. Section 356 extends away from bend 355 at an angle b with respect to a horizontal axis 358 that is substantially parallel to the ground (not shown) and substantially perpendicular to the face of edifice 30. Likewise, section 350 extends away from bend 355 at and angle a with respect to axis 358. Angles a and b are preferably both acute angles, resulting in bend 355 being below the lip 362 of gutter 20 and forming a valley to facilitate the flow of water toward bend 355 from both sections 350 and 356. The exact size of angles a and b primarily depend on the orientation of gutter 20 with respect to the edifice, the angle of roofing 220, as well as the positioning of bracket 40.

In the preferred embodiment shown in FIG. 11, angle a is approximately thirty degrees while angle b is approximately twenty degrees. Alternatively, angle b could be approximately zero degrees resulting in section 256 being substantially parallel with respect to axis 358, and substantially even with inner edge 362. In this embodiment, section 356 includes holes 60 while section 350 does not, since it is not necessary to form holes in section 350 as all water traveling into the valley formed by bend 355 will gather and pass through holes 60 formed on section 356, however, holes can also be formed on section 350, as in FIGS. 5–8. As in all embodiments described herein, although holes are used to strain water through the leaf guard, any appropriately sized aperture of any appropriate shape can be use that permits water to flow into the gutter while substantially preventing debris from entering the gutter.

The leaf guard of FIGS. 10 and 11 further includes a third L-shaped section 364 connected to section 356 at bend 360. The L-shaped section 364 includes a bend 366 to form an "L" adapted to sit on bracket 40. Preferably, bend 360 is substantially flush with inner lip 362 of gutter 20 to prevent debris from entering gutter 20, while end 365 of the leaf guard is also substantially flush with inner edge of bracket 40. As an alternative to the "L" shaped section 364, the guard of FIGS. 10–11 could be constructed to mate with the gutter as in any of the other embodiments shown herein, for example, the section could be extend around the edge of the gutter and be attached by a sheet metal screw as in FIG. 7.

Figure 12:
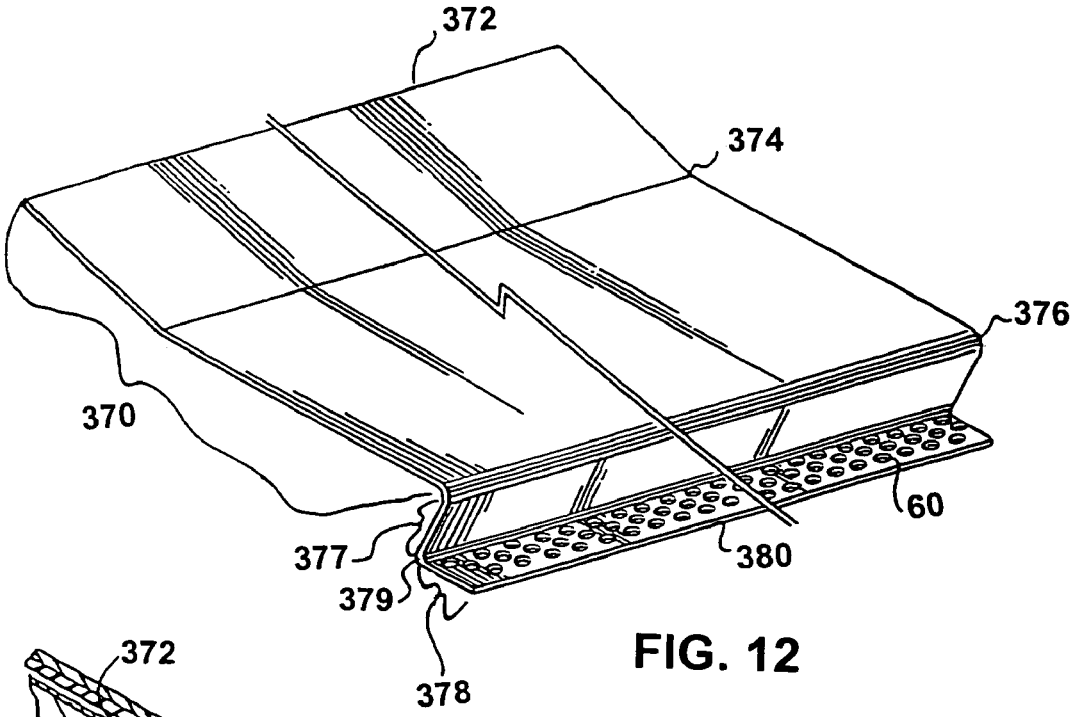
FIGS. 12 and 13 are perspective and cross-sectional mounted views, respectively, of another alternative embodiment of a leaf guard.
Figure 13:
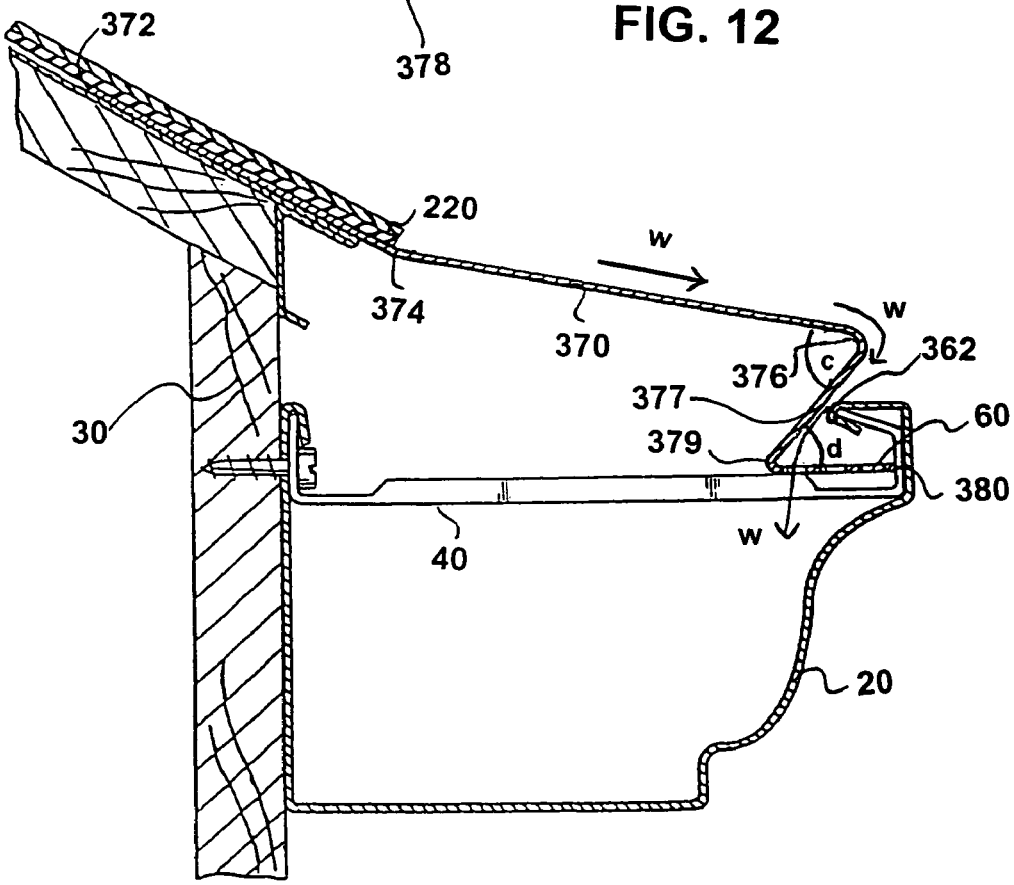

FIGS. 12 and 13 show another alternative embodiment of a leaf guard consistent with the present invention, shown mounted to a gutter 20 and edifice 30 in FIG. 13. The leaf guard is again made from a single piece of rigid material, preferably sheet metal or plastic, and includes a first section 370 that includes a first end 372 to slide under and be positioned beneath roofing 220. The first section optionally includes a slight bend 374 to show the installer how far section 370 should be slid under roofing 220, as well as to properly angle the guard relative to the gutter 20. In this embodiment, unlike the embodiment shown in FIGS. 10–11, the bend 374 is upward instead of downward due to the different construction of the guard in FIGS. 12–13.

Section 370 ends at bend 376 at which section 377 begins. Bend 376 preferably extends outwardly from the edifice 30 past inner lip 362 of gutter 20 to prevent debris from falling into gutter 20. Accordingly, angle c formed by bend 376 is preferably an acute angle, although an angle of about ninety degrees could be used as well, in which an "L" shape would be formed similar to section 364 in FIGS. 10–11. If an angle of about ninety degrees is used, however, the bend 376 obviously cannot extend past inner lip 362.

Section 377 ends at another bend 379 forming another acute angle d. Section 378 begins at bend 379 and ends at the end 380 of the guard, and includes holes 60 to permit water to pass therethrough. Section 378 preferably sits on bracket 40 substantially parallel to bracket 40 and the ground (not shown). Preferably, there are no holes in either section 370 or 377, thus, the likelihood of any debris getting into gutter 20 is greatly reduced. Hydrophilic properties will cause water to adhere to the guard. Thus, water will flow down section 370, around bend 376, down section 377 (and past inner edge 362 of gutter 20), onto section 378 and through holes 60, as indicated by arrow W.

Having thus described several particular embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is limited only as defined in the following claims and the equivalents thereto.

What is claimed is:

1. A leaf guard for a gutter mounted on an edifice, the leaf guard being formed of a single sheet of rigid material and comprising:

a first section having one end adapted to be secured to the edifice, the one end forming a first end of the leaf guard, the first section adapted to extend from the edifice to substantially an inner edge of the gutter, wherein the first section does not permit water to pass therethrough;

a substantially planar second section connected to the first section, the second section including apertures to permit water to pass therethrough and an end of the second section forming a second end of the leaf guard which faces a direction substantially opposite said first end of the leaf guard, the second section being adapted to rest on a bracket used to mount the leaf guard to the gutter; and a substantially planar third section that directly connects the first section to the second section and is adapted to be spaced from the inner edge of the gutter and extend into the gutter, wherein the second section extends from the third section to an interior surface of the gutter below the inner edge of the gutter, wherein the third section is connected to the first section via a first bend and the first bend forms an acute angle in the leaf guard, the acute angle adapted to face the inside of the gutter.

2. The leaf guard of claim 1, wherein said second section is adapted to be located inside the gutter.

3. The leaf guard of claim 1, wherein the first section is adapted to extend slightly above and past the inner edge of the gutter.

4. The leaf guard of claim 1, wherein water is adapted to flow over the surface of the first and third section and through the apertures of the second section.

5. The leaf guard of claim 1, wherein the second section is connected to the third section via a second bend, the acute angle is a first acute angle, and the second bend forms a second acute angle in the leaf guard, the second acute angle adapted to face away from the first acute angle.

6. The leaf guard of claim 1, wherein the second section is adapted to extend to the interior surface of the gutter below the inner edge of the gutter substantially perpendicular to the edifice.

* * * * *